US009427370B2

(12) United States Patent
Fair et al.

(10) Patent No.: US 9,427,370 B2
(45) Date of Patent: Aug. 30, 2016

(54) KIT FOR REHABILITATION APPARATUS

(71) Applicants: Robert Fair, Eaton, IN (US); Matt Fair, Zionsville, IN (US)

(72) Inventors: Robert Fair, Eaton, IN (US); Matt Fair, Zionsville, IN (US)

( * ) Notice: Subject to any disclaimer, the term of this patent is extended or adjusted under 35 U.S.C. 154(b) by 650 days.

(21) Appl. No.: 13/835,707

(22) Filed: Mar. 15, 2013

(65) Prior Publication Data

US 2014/0094723 A1 Apr. 3, 2014

Related U.S. Application Data

(60) Provisional application No. 61/707,910, filed on Sep. 29, 2012.

(51) Int. Cl.

| | |
|---|---|
| ***A61H 1/00*** | (2006.01) |
| ***A63B 21/00*** | (2006.01) |
| ***A61H 1/02*** | (2006.01) |
| ***A63B 17/00*** | (2006.01) |
| ***A63B 23/03*** | (2006.01) |
| *A63B 21/02* | (2006.01) |
| *A63B 23/035* | (2006.01) |
| *A63B 71/00* | (2006.01) |

(52) U.S. Cl.

CPC ..... *A61H 1/008* (2013.01); *A61H 1/024* (2013.01); *A61H 1/0281* (2013.01); *A63B 17/00* (2013.01); *A63B 21/00185* (2013.01); *A63B 21/154* (2013.01); *A63B 21/4013* (2015.10); *A63B 21/4021* (2015.10); *A63B 21/4043* (2015.10); *A61H 2201/1269* (2013.01); *A61H 2201/1276* (2013.01); *A63B 21/00181* (2013.01); *A63B 21/023* (2013.01); *A63B 23/03541* (2013.01); *A63B 2071/0018* (2013.01); *A63B 2208/0204* (2013.01); *A63B 2208/0233* (2013.01); *A63B 2208/0238* (2013.01); *A63B 2210/50* (2013.01)

(58) Field of Classification Search

CPC ..... A61H 1/0218–1/0229; A61H 2201/1253–2201/1284; A61H 2201/165–2201/1652; A63B 17/00; A63B 21/00007; A63B 21/00018; A63B 21/00027; A63B 21/00185; A63B 21/151; A63B 21/154–21/156; A63B 22/0002; A63B 22/0007; A63B 22/001–22/0015; A63B 2022/0005; A63B 2022/0017; A63B 2022/0094; A63B 23/03516; A63B 23/03541; A63B 2208/0204; A63B 2208/0233; A63B 2208/0238; A61B 2210/50

See application file for complete search history.

(56) References Cited

U.S. PATENT DOCUMENTS

| | | | | |
|---|---|---|---|---|
| 1,114,458 | A | 10/1914 | Friedli | |
| 2,928,675 | A | 3/1960 | Nawara | |
| 4,002,856 | A * | 1/1977 | Sedlacek | H04Q 1/064 361/827 |
| 4,153,244 | A | 5/1979 | Tauber, Jr. | |
| 5,031,605 | A * | 7/1991 | Mills | A63B 21/154 482/131 |
| 5,556,369 | A * | 9/1996 | Roberts | A63B 21/4017 482/131 |

(Continued)

*Primary Examiner* — Rachel Young

(74) *Attorney, Agent, or Firm* — Ray Meiers; Endurance Law Group

(57) ABSTRACT

A kit for assisting a disabled person in rehabilitation is disclosed herein. The kit includes a frame. The kit also includes at least one loop mounted on the frame. The loop defines a first opening. The kit also includes a flexible elongate member extending between first and second opposite ends. The flexible elongate member is selectively receivable in the at least one loop. The kit also includes first and second attachment members. The first and second attachment members can be connected at one of the first and second opposite ends of the flexible elongate member or at some point between the first and second opposite ends. Each of the first and second attachment members is operable to form an opening of variable size to receive and releasably tighten around a limb of the disabled person.

17 Claims, 3 Drawing Sheets

(56) References Cited
U.S. PATENT DOCUMENTS 6,592,502 B1 * 7/2003 Phillips ..... A61H 1/0214
482/121
2005/0119095 A1 * 6/2005 Kramer ..... A61H 1/02
482/130
2008/0318742 A1 * 12/2008 Califano ..... A63B 21/143
482/124
2010/0041526 A1 * 2/2010 Bowser ..... A63B 21/04
482/123

* cited by examiner

KIT FOR REHABILITATION APPARATUS

BACKGROUND OF THE INVENTION

1. Field of the Invention

The invention relates to a kit for assembling an apparatus intended to be operated by a human user for the purpose of facilitating the conditioning or rehabilitation of nerve and muscle stimulation of a limb or muscle of the user by repetitive or continuous activity of the user, wherein the weight a body part of the user or an energy storage device can be utilized.

2. Description of Related Prior Art

U.S. Pat. No. 2,928,675 discloses a therapeutic apparatus. The therapeutic apparatus includes a pivotally supported platform, means for imparting a seesaw motion to the platform while the latter supports a recumbent patient thereon, and a pair of longitudinal rails in spaced relation with the platform and connected thereto. The principal object of the therapeutic apparatus is the provision, in connection with an angularly shiftable platform which supports a patient in a recumbent position, of adjustable stop members at the ends of the platform for preventing sliding of a patient's body in a longitudinal relation with the platform while the latter makes teeter or seesaw motions.

SUMMARY OF THE INVENTION

In summary, the invention is a kit for assisting a disabled person in rehabilitation. The kit includes a frame. The kit also includes at least one loop mounted on the frame. The loop defines a first opening. The kit also includes a flexible elongate member extending between first and second opposite ends. The flexible elongate member is selectively receivable in the at least one loop. The kit also includes first and second attachment members. The first and second attachment members can be connected at one of the first and second opposite ends of the flexible elongate member or at some point between the first and second opposite ends. Each of the first and second attachment members is operable to form an opening of variable size to receive and releasably tighten around a limb of the disabled person. Further this apparatus can reduce or eliminate the need of expensive electro-mechanical machines and/or a second person to facilitate rehabilitation of an injured person who needs to move a limb in a desired path and/or a repetitive motion.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
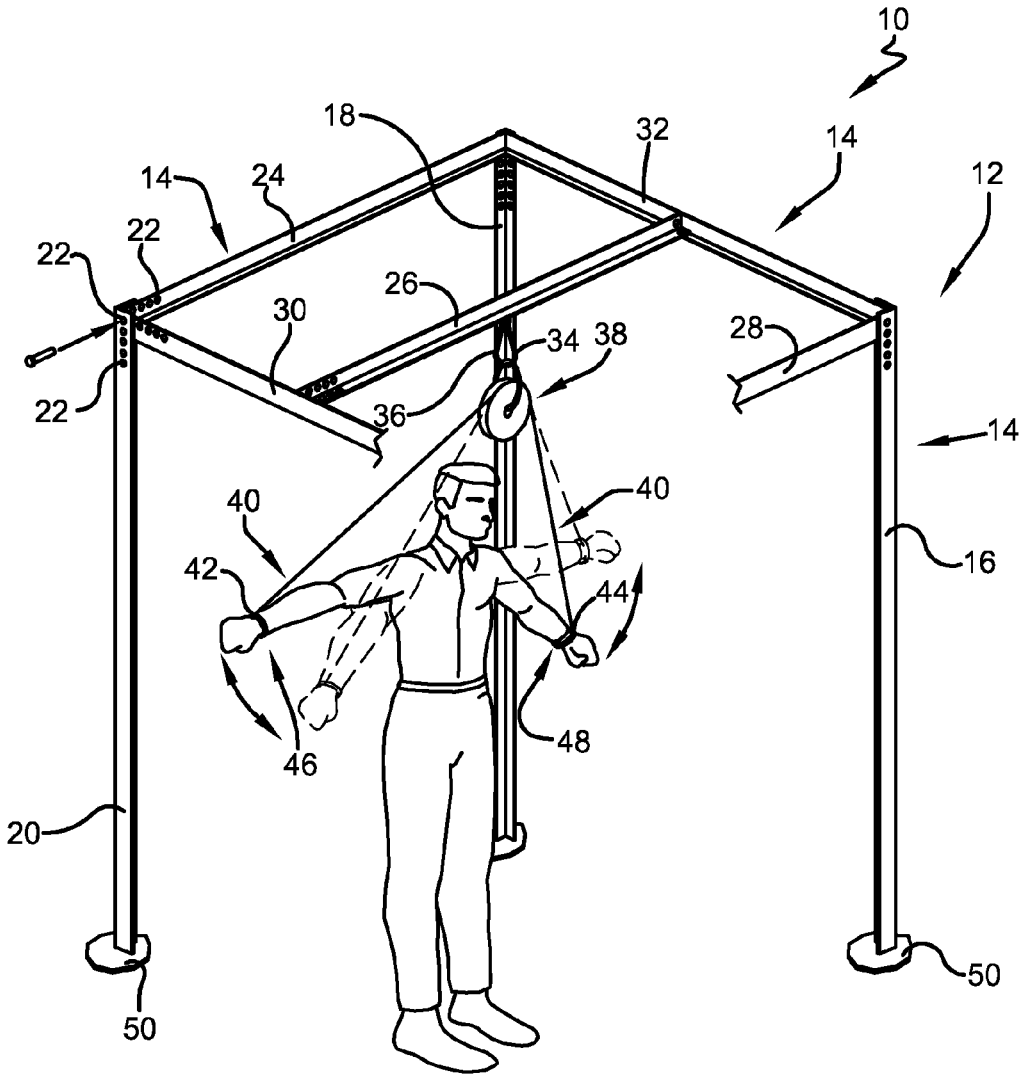
FIG. 1 is a perspective view of a first exemplary embodiment of the invention in a first configuration.

A plurality of different embodiments of the invention is shown in the Figures of the application. Similar features are shown in the various embodiments of the invention. Similar features have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The invention, as demonstrated by the exemplary embodiment described below, provides a rehabilitation apparatus. Embodiments of the invention can be useful for people generally, but can be particularly beneficial to a person having one or more impaired limbs, such as a person in a wheel chair or a person afflicted by a stroke or other debilitating illnesses or injuries. Exemplary embodiments, for example, can allow a person in a wheel chair to move an impaired limb with a limb capable of movement. In this activity, the "moving" or force-exerting limb is beneficially exercised. The impaired or "moved" limb enjoys improved circulation and the movement repairs nerve systems in order to "teach" the limb to respond to signals from the brain to move in a desired way. Exemplary embodiments can also allow a person in a wheel chair to exercise limbs along two transverse axes without having to change position. For example, an arm can be exercised by lifting the other arm or by lifting one of the legs. While one pulley may be used for simple vertical motion, two or more pulley may be utilized in a configuration that permits an injured limb to be moved in any desired direction or path. The injured limb may be returned to its initial position through gravitational force or by way of mechanical advantage such as springs, weights, and the like. Embodiments of the invention can be an apparatus that is free standing or fixed to a support such as a wall, floor, chair or bed. The apparatus can be collapsible for ease of storage or in the alternative can be a permanent structure.

FIG. 1 is a perspective view of an exemplary embodiment of the invention in first configuration. A rehabilitation apparatus 10 according to an exemplary embodiment of the invention can include components combined in a kit. The assembled rehabilitation apparatus 10 can be used for rehabilitation by a person having an impaired limb. Other embodiments of the invention can be used by a person who is bedridden. Generally, at least some embodiments of the invention can be used by a disabled person in exercise without requiring that the person move from the person's primary supporting structure. However, the invention is not limited to such embodiments.

The rehabilitation apparatus 10 can include a frame 12. The exemplary frame 12 can be formed from a plurality of releasably connected members 14. An apparatus according to an embodiment of the invention can be infinitely reconfigurable and positioned through telescoping or releasably fastened structural members with a variety of interconnecting elements. Optionally the structural members can be formed in varying sizes with or without telescoping or other variable configuration features. All useful mechanical features and connections are contemplated by the present invention to facilitate a desired apparatus configuration. Such mechanical features and connections include, but are not limited to elongated slots, apertures, clamps, friction generating devices, resilient mechanisms such as spring loaded protruding members, press fit and loose fit pins, releasable locking features, threaded and non-threaded fasteners, and other equivalent mechanisms. In addition, various apparatus may be made from one or more materials that include but are not limited to metals, woods, plastics, composites, other man-made materials and combinations thereof. The structural members and interconnecting elements may be formed in different cross sectional configurations by way of example and not limitation: circular, square, oval, I-beam, hollow or solid, etc.

A kit according to one exemplary embodiment of the invention can include a plurality of members 14 of different length to accommodate a wide variety of configurations for the frame 12. In the first exemplary embodiment of the invention, each of the members 14 can be L-shaped beams having apertures along at least part of its length to receive a fastener such as a bolt. Each of the members 14 can include apertures along its entire length to maximize the number of possible configurations. Each apparatus 10 in this and other embodiments can have members 14, 16, 18, 20, 22, 24, 26 etc. that can be modified, varied or reconfigured by a user relative to size, shape and length of the members 14, 16, 18, 20. Alternatively, in some embodiments the members 14, 16, 18, 20, 22, 24, 26 etc. can be fixed in size, shape and length for ease of use with a defined application such as a particular wheel chair model or the like.

In the first exemplary embodiment, the plurality of members 14 includes post members 16, 18, 20 (and one not shown) to substantially define a height of the first configuration. It is noted that in FIG. 1 the front corner of the frame 12 is omitted to more clearly show a person engaged in rehabilitation. The post members 16, 18, 20 can be L-shaped beams each having a plurality of apertures, such as aperture 22. It noted that only a few apertures are shown to enhance the clarity of the other structures shown in the drawings. The post members 16, 18, 20 can have substantially the same length, however it is noted that this is not necessary for practicing the invention. Post members of different lengths can be used together by appropriately selecting the apertures 22 used in connecting adjacent members 14.

The plurality of members 14 of the first embodiment can also include cross-members 24, 26, 28, 30, 32. The cross-members 24, 26, 28, 30, 32 can cooperate to interconnect the post members 16, 18, 20 and enhance the rigidity and stability of the frame 12. The cross-member 26 can support a loop 34 defining an opening 36. The loop 34 can be a carabiner. In the first exemplary embodiment, the kit can in a pulley 38 suspended from the loop 34. The pulley connection structure can include hooks that are permanently attached to one of the members or releasable connected. Regardless of how the pulley is attached to an embodiment of the invention, the pulley can be moved to an unlimited number of locations depending on how the embodiment is configured. The loop 34 can be permanently mounted to one of the members 14 or releasably mounted. In various embodiments of the invention, the loop 34 can be mounted to one of the members 14 for swiveling movement or the orientation of the opening 36 can be fixed relative to the frame 12. The exemplary loop 34 can be centered relative to the cross-member 26. In alternative embodiments of the invention, a loop 34 can be mounted to a member at a position spaced from the midpoint of that member 14. It should be noted that a kit according to an embodiment of the invention can include a plurality of loops similar to loop 34. Configurations of the frame 12 can support a plurality of loops and pulleys similar to loop 34 and to pulley 38 to accommodate a plurality of different body motions for rehabilitation.

The rehabilitation apparatus 10 can also include a flexible elongate member 40 extending between first and second opposite ends 42, 44. The flexible elongate member 40 is selectively receivable across the pulley 38. In one embodiment of the invention not including a pulley, the flexible elongate member 40 is selectively receivable through the loop 34.

The rehabilitation apparatus 10 can also include first and second attachment members 46, 48. Each of the first and second attachment members 46, 48 can be connected at one of the first and second opposite ends 42, 44 or at some point along the elongate member 40 between the first and second opposite ends 42, 44. Each of the first and second attachment members 46, 48 is operable to form an opening of variable size to receive and releasably tighten around a limb of the user of the rehabilitation apparatus 10. The attachment members 46, 48 can be formed from an elastic material to accommodate different sizes, or can include a length of hook and loop fasteners that can be variably positioned with respect to one another, or can include a buckle, or any other releasably locking arrangement. Similarly, the connection between the attachment members 46, 48 and the elongate member 40 can be accomplished such that the position of the attachment members 46, 48 is variable. The connection arrangement can include hook and loop fasteners, clips, or any other arrangement.

In the operation of the first exemplary embodiment, a user can pass the elongate member 40 over the pulley 38, affix one attachment member on a first wrist, and affix the second attachment member on the other wrist. The user can then lift one arm by moving the other arm and thereby engage in rehabilitation. The movement of the "driving" limb enhances the circulation in the impaired limb. The positions of the user's arms are shown in solid line and phantom to show corresponding positions over the range of movement.

It is noted that kits according to embodiments of the invention can be advantageously used to assemble frames of various sizes, including minimized sizes. For example, in the first embodiment, the frame 12 can be constructed to have a relatively small footprint. The post members 16, 18, 20 (as well as the omitted post member) can be arranged as close to the user as the user desires. The range of arm motion can extend beyond the envelope defined by the frame 12. In other words, if the user's arms with both extended laterally outward, the distance between the user's hands can be greater than the length of the cross-member 26. Alternatively, the user may desire a larger frame. For example, the user may desire to engage in different motions requiring loops 34 at more than position about the frame 12. To obtain a full range of motion, the frame 12 can be assembled to include additional members 14 and be deeper, wider, longer, or any combination of these three dimensions.

A kit can also include feet for supporting vertically-extending members 14. In the first exemplary embodiment, feet 50 can each receive an end of one of the L-shaped beam post members 16, 18, 20. The feet 50 can enhance the stability of the frame 12 and prevent damage to the post members 16, 18, 20 and/or the floor on which the frame 12 is positioned. The feet 50 can include a blind slot or blind aperture shaped to conform to an end of one post members 16, 18, 20, such that the slot or aperture receives the end and prevents relative movement between the feet 50 and the end.

Figure 2:
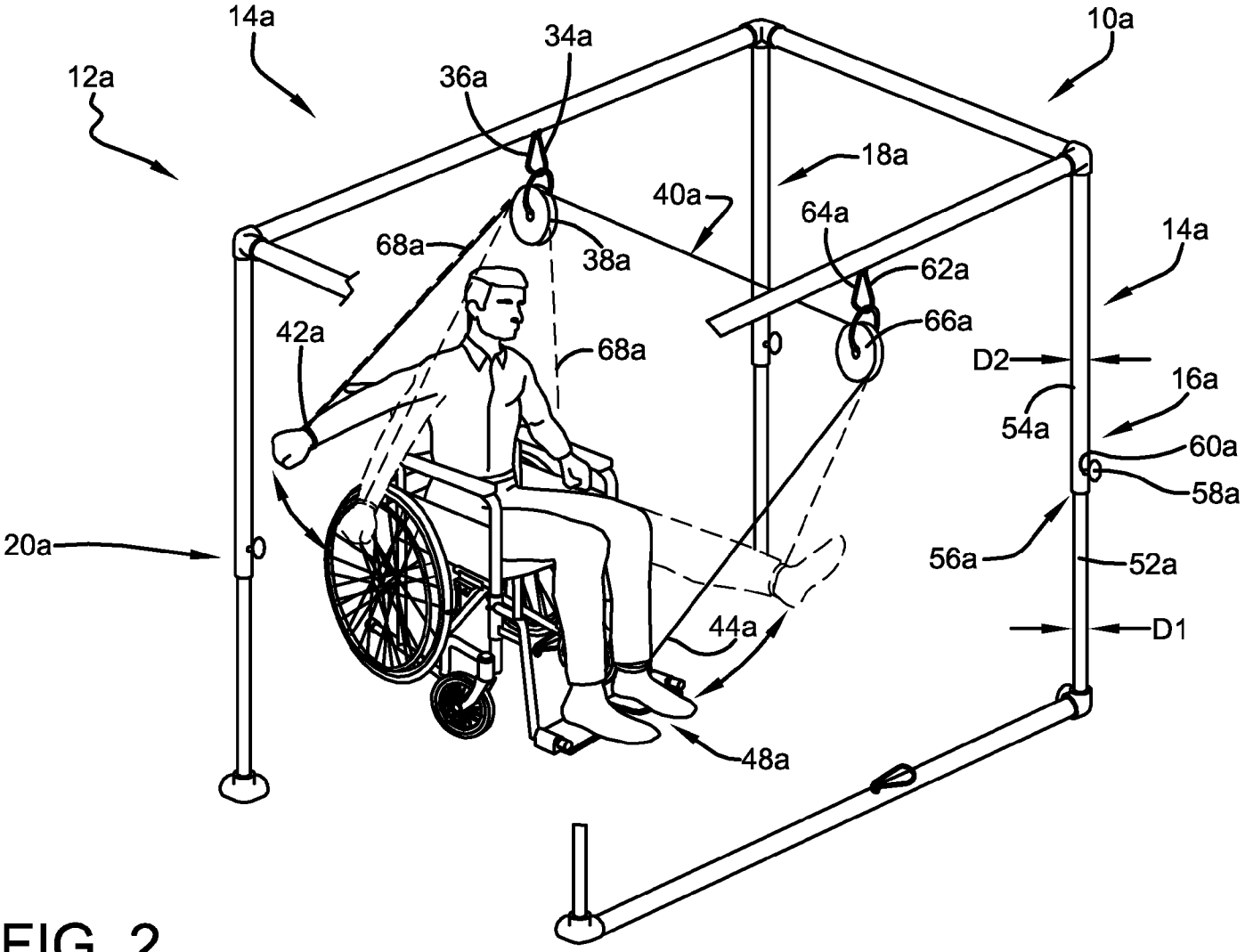
FIG. 2 is a perspective view of a second exemplary embodiment of the invention in a first configuration.

FIG. 2 shows a second embodiment 10*a* of the invention in a first configuration. In the second embodiment, L-shaped beams have been replaced by tubular members 14*a*. Each of the plurality of post members 16*a*, 18*a*, 20*a* can have an adjustable length to vary the height of the frame 12*a*. FIG.

2 shows the exemplary post members 16*a* can include telescoping members 52*a*, 54*a*. The telescoping member 52*a* having a diameter referenced at D1 can be received in the telescoping member 54*a* having a diameter referenced at D2, where D2 is greater than D1.

The position of one telescoping member 52*a*, 54*a* relative the mating telescoping member 52*a*, 54*a* can be fixed by a locking device. An exemplary locking device 56*a* can include a thumb screw 58*a* and a threaded boss 60*a* on the telescoping member 54*a*. The thumb screw 58*a* can be rotated relative to the boss 60*a* until the thumb screw 58*a* engages the telescoping member 52*a* with sufficient force to prevent the telescoping member 52*a* from moving further into the telescoping member 54*a*. It is noted that in other embodiments of the broader invention, differently-configured posts can be used together, differently-configured locking devices can be used, and less than all of the posts could include locking devices. Alternate locking features, by way of example and not limitation, can include press indent button, clamps, rod-like structures extended through aligned apertures.

The rehabilitation apparatus 10*a* can also include at least one loop 34*a* mounted on the frame 12*a* and a pulley 38*a* supported by the loop 34*a*. The second exemplary embodiment can also include a second loop 62*a* defining an opening 64*a* and supporting a second pulley 66*a*. A first flexible elongate member 40*a* can extend between first and second opposite ends 42*a*, 44*a*. The rehabilitation apparatus 10 can also include first and second attachment members 46*a*, 48*a*. Each of the first and second attachment members 46*a*, 48*a* can be connected at one of the first and second opposite ends 42*a*, 44*a* or at some point along the elongate member 44 between the first and second opposite ends 42*a*, 44*a*. Each of the first and second attachment members 46*a*, 48*a* is operable to form an opening of variable size to receive and releasably tighten around a limb of the user of the rehabilitation apparatus 10*a*.

In operation, a user can string the elongate member 40*a* across the pulley 38*a* and the pulley 66*a*, affix one attachment member on a wrist, and affix the second attachment member on an ankle. The user can then lift a leg by moving an arm and thereby engage in rehabilitative movement. The positions of the user's arm and leg are shown in solid line and phantom to show corresponding positions over the range of movement. It is contemplated that any limb or a portion thereof may be the motive limb to cause movement in at least a portion of an injured limb. For example, and not by way of limitation, any combination or portions of legs, arms, hands, fingers, feet, toes, head, and neck and may be used to provide or receive motive force for movement about any desired joint. The second exemplary embodiment of the kit can also include a second flexible elongate member 68*a* (shown in phantom), similar to the first elongate member 40*a*. Such a kit can also have first and second attachment members, like first and second attachment members 46, 48 or 46*a*, 48*a*, interconnected with the second flexible elongate member 68*a*. In a kit having two or more flexible elongate members, the elongate members can have different lengths. The second elongate member 68*a* can be applied in the second embodiment, for example, by a extending the second elongate member 68*a* through the opening 36*a* of the loop 34*a*, affixing one attachment member on the same wrist associated with the attachment member 46*a*, and affixing the other attachment member on the opposing wrist. The user can then lift a leg and an arm by moving one arm and thereby engage in rehabilitative movement. Thus, embodiments of the invention can be operable allow a user to engage in rehabilitative movement concurrently in more than one plane. For example, the motion of the user's leg occurs in a first plane parallel to the plane defined between post members 16*a* and 18*a*. When using the second elongate member as described above, the user's left arm would move in second plane parallel to the plane defined between post members 18*a* and 20*a*. The first and second planes would be transverse (perpendicular or less than fully perpendicular) to one another. Of course, the configuration of the second embodiment would allow the user to engage in rehabilitative movement consecutively in more than one plane. The leg could be moved by the right arm and then the left arm could be moved by the right arm.

Figure 3:
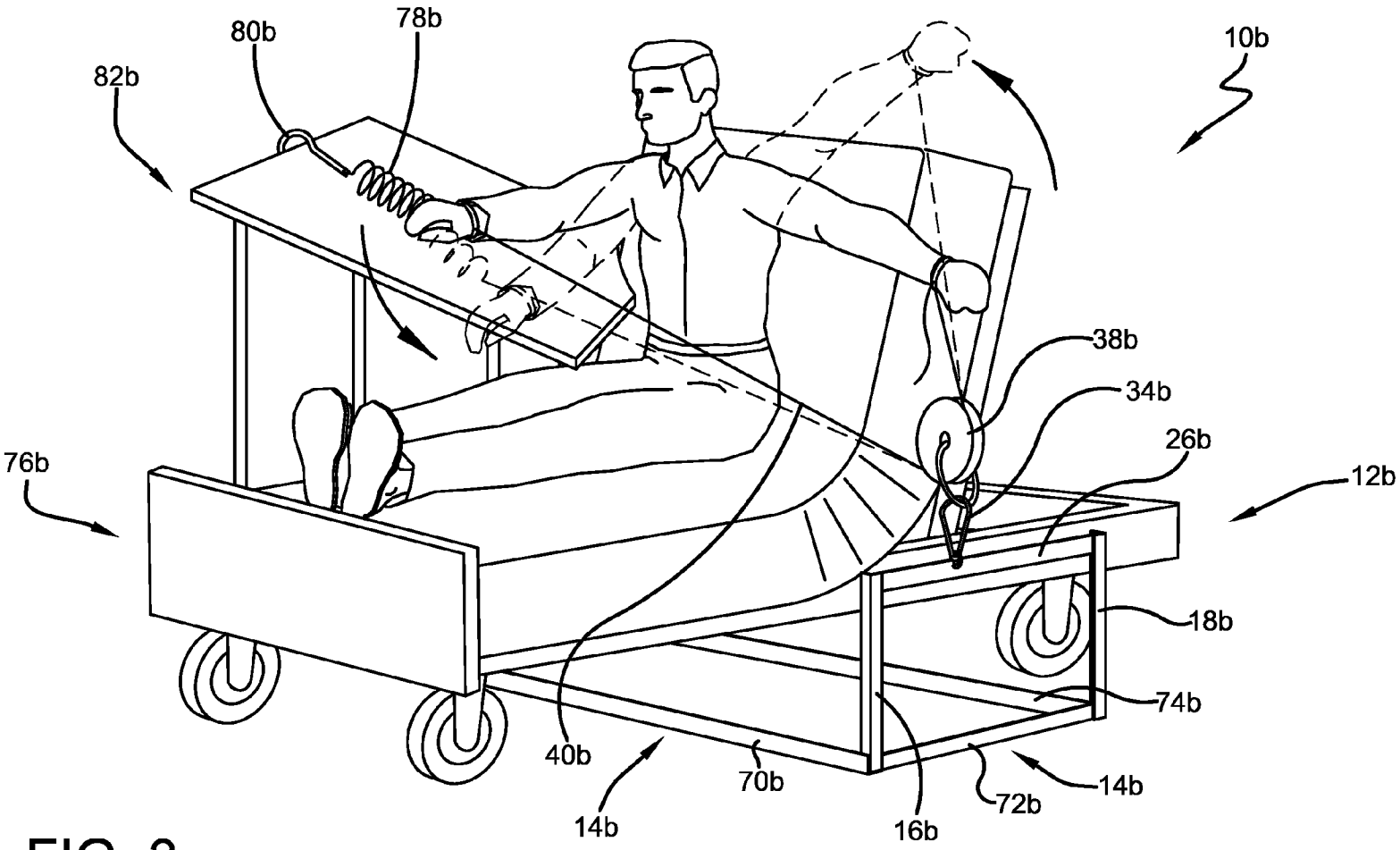
FIG. 3 is a perspective view of a third exemplary embodiment of the invention in a first configuration.

FIG. 3 shows a third embodiment of the invention. A rehabilitation apparatus 10*b* can include a frame 12*b* having a plurality of releasably interconnected members 14*b*. Like the first embodiment, the members 14*b* of the third embodiment can be L-shaped beams. The frame 12*b* has been constructed to support rehabilitative movement for a bed-ridden user. The plurality of members 14*b* includes base members 70*b*, 72*b*, 74*b*, post members 16*b* and 18*b*, and a cross-member 26*b*. A single base member 72*b* is shown extending between the base members 70*b* and 74*b*, however, a plurality of members similar to base member 72*b* can extend between the base members 70*b* and 74*b* to increase the weight of the frame 12*b*. In the third exemplary embodiment of the invention, the base members 70*b* and 74*b* can be disposed under the user's bed 76*b*.

A loop 34*b* can be connected to the cross-member 26*b* and support a pulley 38*b*. A exemplary kit for constructing the third embodiment can also include an energy storage structure, such as spring 78*b*. The spring 78*b* can include opposite ends that accommodate connection to other structures, such as hook 80*b*. In the third exemplary embodiment, the spring 78*b* can be interconnected between the user's wrist (such as through an attachment associated with the elongate member 40*b* but not referenced to enhance drawing clarity) and a partial table 82*b* adjacent to the user's bed 76*b*.

In operation, the user can position the impaired limb such as a left arm on the table 82*b*. The user can also affix a first attachment member connected to the elongate member 40*a* (not referenced to enhance drawing clarity) on a first wrist such as the left wrist, connect the spring to the attachment member on the left wrist, extend the elongate member 40*a* over the pulley 38*a*, and slip the right wrist through the second attachment member connected to the elongate member 40*a* (not referenced to enhance drawing clarity). The user can then move the impaired arm across the table 82*b* by raising the other arm and thereby engage in rehabilitation. During upward movement of the "driving" limb, the spring 78*b* stores energy. When the driving limb is relaxed and lower, the spring 78*b* expends the stored energy and urges the impaired limb back to an original position. Thus embodiments of the invention can be operable to allow a user to engage in rehabilitative motion without the benefit of gravity.

It is noted that the three embodiments have been shown to include squared corners, but alternative embodiments can include interconnection structures allowing connections at angles different than 90°. It is also noted that additional members can be added to the exemplary embodiments to further enhance rigidity and stability if necessary.

Embodiments of the invention can be practiced wherein one limb moves a different distance than the other limb. For example, an embodiment of the invention could include a double pulley arrangement. An elongate member can be connect to a limb at one end, extend over a first pulley, over a second pulley, and be fixed at a second end. The second limb can be connected to the second pulley with a second elongate member. Movement of the first limb would cause the second pulley and the second limb to move. Increasing the number of pulleys would increase the ratio of movement between the first limb and second limb.

It is also noted that eyebolts could be used instead of pulleys to direct movement of an elongate member in embodiments of the invention. The aperture defined by the eyebolt can be coated in antifriction material, overmolded with a material to reduce friction, or receive an insert to reduce friction experienced by the elongate member during movement through the aperture of the eyebolt.

Embodiments of the invention can accommodate different speeds of movement of the disabled limb over the course of movement. For example, an embodiment of the invention can include a cam—cam follower arrangement. The cam can be moved by a first limb and be shaped to induce variable-speed movement of the cam follower. The disabled limb can be operably engaged with the cam follower.

The present disclosure provides a rehabilitation apparatus. The rehabilitation apparatus can include a frame having a plurality of pulley connections for permitting variable placement of at least one pulley. The frame can be adjustably configurable among a plurality of different configurations. In some embodiments, the frame can be reconfigurable in size and shape. Alternatively, the frame can be formed with fixed dimensions. The rehabilitation apparatus can also include at least one pulley positioned on the frame. The rehabilitation apparatus can also include a tension cable operably connected to the at least one pulley. The rehabilitation apparatus can also include a pair of limb attachment members connected to opposing ends of the tension cable. The apparatus can be operable to facilitate movement and motive force of one limb to cause an injured limb to move in any desired path. The rehabilitation apparatus can also include a fixed support, wherein the frame is releasably attachable to a fixed support. Structures associated with such a rehabilitation apparatus are disclosed herein and described above.

The present disclosure provides an apparatus comprising a structural frame formed in a desired configuration. The desired configuration can be one of a plurality of different configurations. The apparatus can include means for operably connecting an injured limb to the frame. Structural examples of means for operably connecting an injured limb to the frame are described supra. The apparatus can also include means for operably attaching a second limb to the injured limb such that the second limb is capable of moving the injured limb. Structural examples of means for operably attaching a second limb to the injured limb such that the second limb is capable of moving the injured limb are described supra. The apparatus can also include means for defining a desired path of moving the injured limb. Structural examples of means for defining a desired path of moving the injured limb are described supra. The desired path of movement can be altered by modifying the connecting means to the frame in some embodiments.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Further, the "invention" as that term is used in this document is what is claimed in the claims of this document. The right to claim elements and/or sub-combinations that are disclosed herein as other inventions in other patent documents is hereby unconditionally reserved.

What is claimed is:

1. A kit for assisting a disabled person in rehabilitation comprising:

a frame;

at least one loop mounted on said frame;

a flexible elongate member extending between first and second opposite ends and selectively receivable in said at least one loop;

first and second attachment members respectively connected one of at and between said first and second opposite ends of said flexible elongate member, wherein said first and second attachment members are operable to form an opening to receive and releasably tighten around first and second limbs of the disabled person; and an energy storage structure releasably engageable with said first attachment member to interconnect said first attachment member with said frame, wherein movement of said second attachment member induces movement of said first attachment member through said flexible elongate member and stores energy in said energy storage structure.

2. The kit of claim 1 wherein said frame comprises a plurality of frame members and at least one dimension of at least one frame member is adjustable.

3. The kit of claim 1, wherein said frame is dimensionally fixed.

4. The kit of claim 1, wherein the frame is reconfigurable in size and shape.

5. The kit of claim 1, wherein said frame further comprises:

a plurality of posts extending vertically and defining the height of said frame, wherein at least one of said posts includes first and second telescoping members.

6. The kit of claim 5, further comprising:

a locking device operably disposed to lock said first telescoping member relative to said second telescoping member.

7. The kit of claim 1, wherein said at least one loop is further defined as a carabiner.

8. The kit of claim 1, wherein said at least one loop is further defined as a substantially fixed eyelet relative to the frame.

9. The kit of claim 1, wherein said at least one loop is further defined as a pulley.

10. The kit of claim 1, wherein said flexible elongate member and said first and second attachment members are configured to cooperate with one another such that a distance between said first and second attachment members along said flexible elongate member is variable.

11. The kit of claim 1, further comprising:

a second flexible elongate member extending between first and second opposite ends of said second flexible elongate member and selectively receivable in said first loop.

12. The kit of claim 8, wherein said flexible elongate member and said second flexible elongate member have different lengths.

13. The kit of claim 1, wherein said frame further comprises:

a plurality of releasably connected members.

14. The kit of claim 13, wherein each of said plurality of releasably connected members is further defined as L-shaped beams having apertures.

15. The kit of claim 13, wherein each of said plurality of releasably connected members is further defined as tubular.

16. A method comprising the steps of:

affixing a first end of a first elongate member to a first limb;

extending the first elongate member about at least one pulley;

affixing a second end of the first elongate member to a second limb;

affixing a first end of a second elongate member to the first limb;

extending the second elongate member about the at least one pulley;

affixing a second end of the second elongate member to a third limb; and moving the first limb to move second and third limbs.

17. The method of claim 16, further comprising:

positioning one or more pulleys in desired locations relative to a frame; and moving a limb along a desired path defined by the one or more pulleys.

* * * * *